US006471289B2

(12) United States Patent
Aguilar

(10) Patent No.: US 6,471,289 B2
(45) Date of Patent: Oct. 29, 2002

(54) CHAIR UMBRELLA

(76) Inventor: Sandra B. Aguilar, 614 Carlisle, Rosenberg, TX (US) 77471

( * ) Notice: Subject to any disclaimer, the term of this patent is extended or adjusted under 35 U.S.C. 154(b) by 0 days.

(21) Appl. No.: 09/799,397

(22) Filed: Mar. 6, 2001

(65) Prior Publication Data

US 2002/0125748 A1 Sep. 12, 2002

(51) Int. Cl.[7] ..... A47C 7/66

(52) U.S. Cl. ..... 297/184.16; 135/16; 135/20.3; 248/534; 248/514

(58) Field of Search ..... 297/184.16, 184.15; 135/16, 20.3; 248/534, 539, 514

(56) References Cited

U.S. PATENT DOCUMENTS 4,318,567 A * 3/1982 Guthier ..... 297/184.16
4,470,630 A * 9/1984 Shields ..... 297/184.16
4,871,141 A * 10/1989 Chen ..... 297/184.16 X
6,105,594 A * 8/2000 Diaz ..... 135/16 X
6,234,187 B1 * 5/2001 Izzo ..... 135/16 X

* cited by examiner

*Primary Examiner*—Anthony D. Barfield
(74) *Attorney, Agent, or Firm*—Bill B. Berryhill

(57) ABSTRACT

An umbrella attached to a chair for self-supported deployment thereof and including a cover of fabric stretched over hinged ribs radiating from a central pole for movement from a collapsed position around the pole to an extended position from the pole to provide shade to the chair occupant. One end of the pole is pivotally mounted allowing the pole to pivot from a downwardly depending position to a generally upwardly directed position where the fabric cover may be moved to its extended shade providing position. A latch device is attached to the pole for releasably holding it in it's upwardly directed position.

8 Claims, 2 Drawing Sheets

CHAIR UMBRELLA

BACKGROUND OF THE INVENTION

1. Field of the Invention

The present invention pertains to umbrellas. More specifically, the present invention pertains to an umbrella which is attached or attachable to a chair for self-supported deployment thereof.

2. Description of the Prior Art

Umbrellas have been in existence for many years. Most umbrellas provide a cover of fabric which is stretched over hinged ribs radiating from a central pole and which is moveable from a collapsed position around the pole to an extended position providing a shade around the pole. Most umbrellas are carried by the user thereof and must be held by one or both hands of an individual to provide shade from the sun or protection from rain and other elements.

Many people desiring to conduct outdoor activities such as fishing, watching sporting events or simply for relaxation sit in an outdoor chair during such activities. Particularly during hot and sunny weather, the occupant of the chair may want protection from the sun or other elements. Holding a standard umbrella, which requires the use of one or both of the occupants hands, reduces the ability of the occupant to participate in or to fully enjoy such activities and even if the occupant is dozing or napping, the umbrella may not be in use.

Various attempts have been made to provide canopies or coverings for chairs to shade the occupants thereof from the sun without having to hold a standard umbrella. One such design is shown in U.S. Pat. No. 4,230,363. However, most of these designs are relatively bulky, cumbersome and not easily used or stored. Thus, further developments are needed to provide shade protection associated with a chair, particularly foldable chairs, which would free the occupants hands but which would provide shade in an easily operable manner and for protecting the occupant regardless of the position of the sun.

SUMMARY OF THE PRESENT INVENTION

The present invention provides an umbrella which is attached or attachable to the frame of a chair, particularly a folding outdoor chair, in which a cover of fabric, stretched over hinged ribs, is moveable from a collapsed position around a central pole to a position radially extended from the pole to provide a shade. The lower end of the pole is pivotally connected to the chair allowing the pole to pivot from a downwardly depending position, when the umbrella cover is in its collapsed position to a generally upwardly directed position where the umbrella cover may be moved to its extended shade providing position. A latching device, at least a portion of which is carried by the central pole is provided to hold the pole in its upwardly directed position. The latch assembly is releasable, to allow the pole to be returned to its downwardly depending position.

In a preferred embodiment of the invention, a portion of the central pole is provided with a flexible joint which allows at least an upper part of the post and the fabric cover to be moved to a plurality of radially directed positions, relative to the vertical, providing shade to the chair occupant regardless of the position of the sun.

If the umbrella portion of the present invention is utilized with a folding chair, it may be moved to its downwardly depending position as the chair is folded up so that it can be easily carried and stored with the foldable chair. If the umbrella is permanently attached to the chair, it can never be forgotten and the occupant of the chair can deploy the umbrella in self-support when needed. Many other objects and advantages of the invention will be understood from reading the description which follows in conjunction with the accompanying drawings.

DESCRIPTION OF PREFERRED EMBODIMENTS OF THE INVENTION

Figure 1:
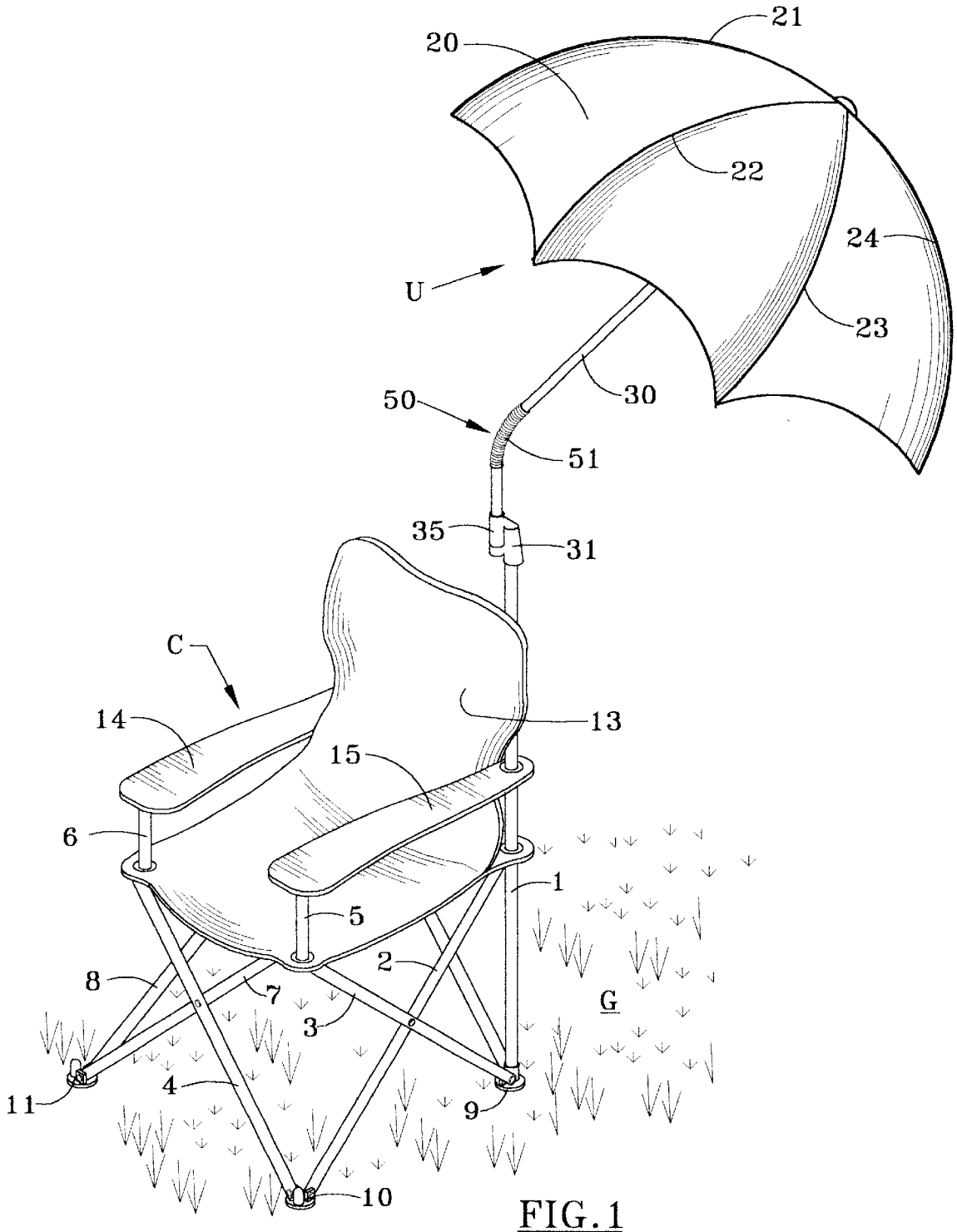
FIG. 1 is a pictorial representation of a folding chair with an associated self-supported umbrella attached thereto, according to a preferred embodiment of the invention.
Figure 2:
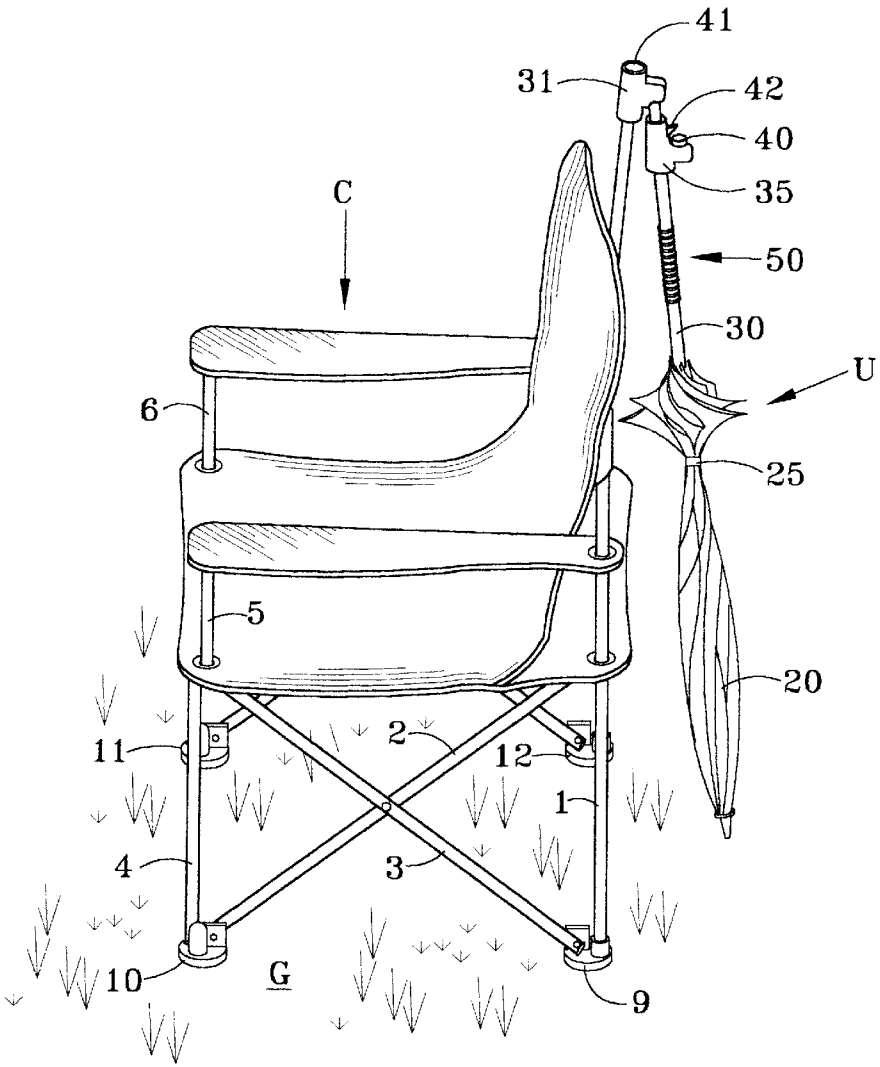
FIG. 2 is another pictorial view of the chair and umbrella of FIG. 1 showing the umbrella portion thereof in a collapsed and downwardly depending position when not in use or in position for storage, according to a preferred embodiment of the invention.

Referring first to FIGS. 1 and 2, there is shown a chair C and an associated umbrella U according to a preferred embodiment of the invention. The chair C could be of any number of types of chairs and is illustrated as being a foldable chair such as is frequently utilized for outdoor activities. The chair provides a frame of several structural elements 1, 2, 3, 4, 5, 6, 7, 8 to which are attached pads 9, 10, 11 and 12 which rest of the ground G or another supporting surface. The structural elements 1–8 and the pads 9–12 may be pivotally attached in such a way as to allow the chair to be folded up in a compact fashion for transporting and storing. The illustrated chair C includes a fabric seat and back 13 and fabric arm rests 14 and 15 supported on the frame of the chair. The structural member 1 extends upwardly from the back of the chair for supporting the umbrella U as will be more fully understood hereafter.

The umbrella U, similar to many umbrellas, comprises a cover of fabric 20 stretched over hinged ribs 21, 22, 23, 24, etc. which radiate from a specially designed central pole 30. The cover 20 and ribs 21–24, etc. are moveable from a collapsed position around the pole 30 to an extended position, as shown in FIG. 1, to provide a shade around the pole 30 and to any occupant of the chair C.

Figure 3:
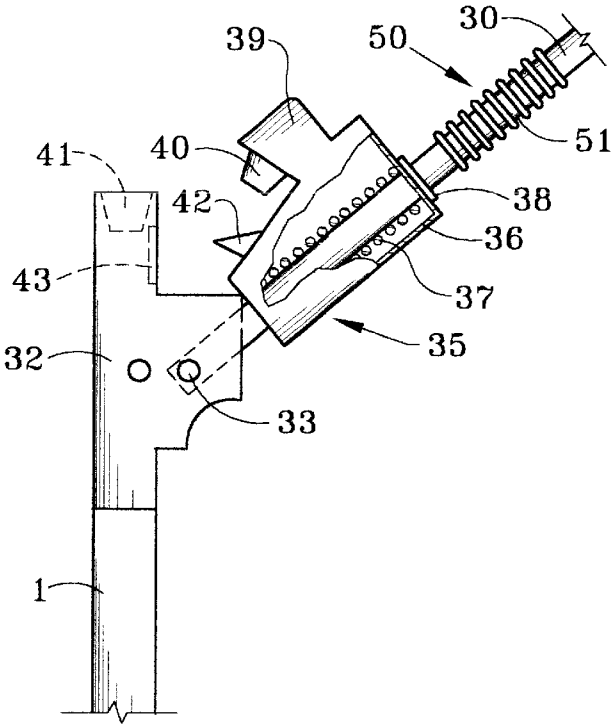
FIG. 3 is a detailed view of portions of the chair and umbrella of FIGS. 1 and 2, illustrating components which allow the unique operation thereof, according to a preferred embodiment of the invention.

In the embodiment of FIGS. 1 and 2, the umbrella U is attached to the chair support 1 by a mounting member 31. The mounting member 31 may be removably attached to the chair support 1 or permanently affixed thereto. In FIG. 3, the mounting member 32 is illustrated as being permanently attached to the chair support 1.

Whether the umbrella is attached by a removable mounting member 31 or a permanently affixed member 32, the lower end of the pole 30 is attached by a pivot connection, such as illustrated at 33 in FIG. 3, which allows the pole 30 to pivot from a downwardly depending position, when the fabric cover 20 is collapsed, such as shown in FIG. 2, to a generally upwardly directed position where the fabric cover 20 may be moved to its extended shade providing position, such as shown in FIG. 1. The pole 30 is shown in an intermediate position in FIG. 3 as it is moved between the downwardly depending position of FIG. 2 and the upwardly extending position of FIG. 1. A latch assembly 35 is attached to the pole 30 for releasably holding the pole 30 in the upwardly directed position of FIG. 1.

In the embodiment of FIGS. 1, 2 and 3 and as best seen in FIG. 3, the latch assembly 35 comprises a latch body 36 which surrounds the lower end of the central pole 30 and carries a tension spring 37 which biases the latch body 36 towards the pivot 33. The latch body has an extension 39 below which is a protrusion 40. The upper end of the mounting member 32 in FIG. 3 or the comparable mounting member 31 in FIGS. 1 and 2, is provided with a corresponding recess 41. In addition, the latch body 36 also carries an extending rib 42 and the mounting member 32 is provided with a corresponding slot 43.

If the umbrella U is pivoted toward the upwardly directed position of FIG. 1, the protrusion 40 will cooperatively engage the recess 41 to releasably hold the pole 30 and umbrella U in the generally upwardly directed position of FIG. 1. As this occurs, the spring 37 is compressed, either manually or due to the inclined surfaces of the protrusion 40, until the protrusion 40 is aligned with the recess 41, at which point the spring 37 would force the protrusion 40 into the recess 41 to hold the pole in its upwardly directed position. As this occurs, the rib or extension 42 also engages the slot 43 to prevent twisting of the pole 30 relative to the mounting 32 (or 31). To release the latch 35 and the pole 30 from the position of FIG. 1, the latch body may be manually moved upwardly on the pole 30 by compressing the spring 37 and withdrawing the protrusion 40 from the recess 41. This allows the pole 30 and umbrella U to pivot about the pivot point 33 for movement to the depending position of FIG. 2.

Only one embodiment of the latch assembly 35 is described herein. The assembly may be modified in a number of ways. For example the protrusion 40 and recess 41 might be reversed so that the recess would be carried by the latch housing 36 and the protrusion by the mounting member 32. Likewise, the positions of the rib 42 and slot 43 could be reversed so that the slot 43 would be carried by the latch housing 36 and the rib 42 would extend from the mounting member 32. In fact, many latch assemblies could be adapted for use with the present invention provided they would operate in substantially the same manner, that is, to releasably hold the pole 10 in its upwardly directed position and allowing release so that the pole can be moved to its downwardly depending position.

Another unique feature of the present invention is a flexible joint 50 by which an upper portion of the central pole 30 is joined to a lower portion thereof. In the exemplary embodiment, the flexible joint 50 comprises a spirally wound coil member 51 which surrounds joining portions of the central pole 30 and which is bendable in a plurality of radially directed positions, relative to the lower part of the central pole 30, for positioning the umbrella U and the fabric cover 20 thereof to provide a shade to the occupant of the chair C regardless of the position of the sun. FIG. 1 illustrates the flexible joint 50 bent so that the upper part of the pole 30 and the cover 20 rests in an angular position relative to the lower part of the pole.

Prior to use of the umbrella U for shading, it would normally be carried in the downwardly depending position of FIG. 2. A strap 25 could be utilized to hold the cover in its collapsed position. The chair C would be unfolded, as shown in FIGS. 1 and 2, and when desired, the central pole 30 could be raised to the extended upwardly directed position of FIG. 1, releasably latched in such position and the umbrella cover 20 moved to its extended shade providing position as shown in FIG. 1. The flexible joint 50 could be bent or manipulated by applying a force to the upper portion of the central pole 30 so that the cover 20 would provide a shade to the occupant of the chair C regardless of the position of the sun.

After use, the latch assembly 35 could be released and the umbrella U returned to the downwardly depending position of FIG. 2. If the chair C is a foldable chair, the chair could be folded up and the chair and attached umbrella U could be transported and stored in a collapsed compact manner. In fact, they could be easily stored in an elongated bag of relatively small diameter.

The umbrella U alone or in combination with a chair such as the chair C is unique in construction and operation. It affords shade to the occupant, regardless of the position of the sun, leaving the occupant's hands free for other activities or simply for total inactivity. The design is relatively simple and easily adaptable to many types of chairs, particularly foldable chairs. It would be relatively inexpensive and very effective in protecting the occupant from the sun or other weather elements.

Several embodiments of the invention have been described herein. However, many variations of the invention may be made by those skilled in the art without departing from the spirit of the invention. Accordingly, it is intended that the scope of the invention be limited only by the claims which follow.

What is claimed is:

1. An umbrella attachable to a chair for self-supported deployment thereof comprising:

mounting means attachable to the frame of said chair for supporting said umbrella therefrom;

a cover of fabric stretched over hinged ribs radiating from a central pole and which is moveable from a collapsed position around said pole to an extended position from said pole to provide a shade around said pole, a distal end of said pole being pivotally attached to said mounting means allowing said pole to pivot from a downwardly depending position, when said fabric cover is in said collapsed position, to a generally upwardly directed position where said fabric cover may be moved to said extended shade providing position; and latch means attached to said pole for releasably holding said pole in said upwardly directed position;

said central pole being provided with a flexible joint which allows an upper part of said pole and said fabric cover to be moved to angular positions relative to a lower part of said pole, said flexible joint comprising a spirally wound coil member surrounding said central pole and bendable in a plurality of radially directed positions relative to said lower part of said pole.

2. The chair attachable, self-supported umbrella set forth in claim 1 in which one of said mounting means and said latch means is provided with a recess and the other of said mounting means and said latch means is provided with a protrusion, said protrusion being cooperatively engageable with said recess, to releasably hold said pole in said generally upwardly directed position when pivoted thereto.

3. The chair attachable, self-supported umbrella set forth in claim 2 in which said latch means comprises a spring member which biases said latch means toward a position in which said recess and said protrusion are engaged, said latch means being manually moveable to a position for disengagement of said recess and said protrusion.

4. The chair attachable, self-supported umbrella set forth in claim 2 in which one of said mounting means and said latch means is provided with a slot and the other of said mounting means and said latch means is provided with a fixed rib engageable with said slot, upon engagement of said protrusion with said recess, to prevent twisting of said pole relative to said mounting means.

5. An outdoor chair having a frame which includes an upwardly extending support in combination with a self-supported umbrella, said umbrella comprising:

a cover of fabric stretched over hinged ribs radiating from a central pole and which is moveable from a collapsed position around said pole to an extended position from said pole to provide a shade around said pole, the lower end of said pole being pivotally attached to said extending chair support allowing said pole to pivot from a downwardly depending position, when said fabric cover is in said collapsed position, to a generally upwardly directed position where said fabric cover may be moved to said extended shade providing position; and latch means at least a portion of which is carried by said pole for releasably holding said pole in said upwardly directed position;

said central pole being provided with a flexible joint which allows at least an upper part of said pole to be moved to angular positions relative to said upwardly extending chair support, said flexible joint comprising a spirally wound coil member which is bendable in a plurality of radially directed positions relative to said upwardly extending chair support for positioning said fabric over to provide shade to a person occupying said chair, regardless of the position of the sun.

6. The combination chair and self-supported umbrella set forth in claim 5 in which one of said chair support and said latch means is provided with a slot and the other of said chair support and said latch means is provided with a fixed rib engageable with said slot, upon movement of said pole to said upwardly directed position, to prevent twisting of said pole relative to said chair support.

7. An outdoor chair in combination with a self-supported umbrella, said umbrella comprising:

mounting means attachable to the frame of said chair for supporting said umbrella therefrom;

a cover of fabric stretched over hinged ribs radiating from a central pole and which is moveable from a collapsed position around said pole to an extended position from said pole to provide a shade around said pole, the lower end of said pole being attached to said mounting means for placing said pole in a generally upwardly directed position where said fabric cover may be moved to said extended shade providing position; and latch means at least a portion of which is carried by said pole for releasably holding said pole in said generally upwardly directed position;

said combination chair and self-supported umbrella being further characterized in that said central pole is provided with a flexible joint which allows at least an upper part of said pole and said fabric cover to be moved to angular positions relative to the vertical when said pole is in said generally upwardly directed position, said flexible joint comprising a spirally wound coil member which is bendable in a plurality of radially directed positions relative to said vertical for positioning said fabric cover to provide a shade to a person occupying said chair regardless of the position of the sun.

8. The combination chair and self-supported umbrella set forth in claim 7 in which said latch means comprises a spring member which biases said latch means toward a position of engagement, said latch means being manually moveable to a position for disengagement.

* * * * *